US012196063B2

(12) United States Patent
Mufleh et al.

(10) Patent No.: US 12,196,063 B2
(45) Date of Patent: Jan. 14, 2025

(54) ELECTRIC POWER GENERATION BY FLOW THROUGH ELECTRICAL SUBSMERSIBLE PUMP (ESP) SYSTEMS

(71) Applicant: SAUDI ARABIAN OIL COMPANY, Dhahran (SA)

(72) Inventors: Jamal S. Mufleh, Dhahran (SA); Abdullah I. Muraikhi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/305,915

(22) Filed: Apr. 24, 2023

(65) Prior Publication Data

US 2024/0352831 A1 Oct. 24, 2024

(51) Int. Cl.
*E21B 41/00* (2006.01)
*E21B 43/12* (2006.01)

(52) U.S. Cl.
CPC ..... *E21B 41/0085* (2013.01); *E21B 43/128* (2013.01)

(58) Field of Classification Search
CPC ..... E21B 41/0085; E21B 43/128
See application file for complete search history.

(56) References Cited

U.S. PATENT DOCUMENTS

2009/0218091 A1* 9/2009 Dotson ..... E21B 43/128 166/265
2015/0098794 A1* 4/2015 Baski ..... F04D 29/086 415/1
2022/0282695 A1* 9/2022 Peviani ..... F03G 4/026
2023/0243330 A1* 8/2023 Rasmussen ..... E21B 41/0085 405/53
2023/0323851 A1* 10/2023 Holland ..... F03B 17/062 166/244.1
2024/0141758 A1* 5/2024 Al-Mousa ..... E21B 21/08

FOREIGN PATENT DOCUMENTS

EA 014944 B1 4/2011
KR 101721388 B1 4/2017

* cited by examiner

*Primary Examiner* — Brad Harcourt
(74) *Attorney, Agent, or Firm* — Vorys, Sater, Seymour and Pease LLP

(57) ABSTRACT

A system includes at least one or more wellbores penetrating a subterranean production zone, a downhole electrical submersible (ESP) assembly operable to generate electricity and configured to be installed within the at least one or more wellbores and including a pump intake, a pump operatively coupled to the pump intake, the pump including an impeller responsive to a flow of formation fluid from the pump intake, a motor generator operatively coupled to the impeller to generate electricity in response to rotation of the impeller, a configuration of surface equipment in communication with the downhole ESP assembly and including a controller at surface configured to receive electricity from the motor generator and an electrical apparatus operatively coupled to the controller to receive the electricity, wherein at least one of the one or more wellbores the pump makes operable the motor generator to generate electricity that is conveyed to the surface equipment.

18 Claims, 3 Drawing Sheets

ELECTRIC POWER GENERATION BY FLOW THROUGH ELECTRICAL SUBSMERSIBLE PUMP (ESP) SYSTEMS

FIELD OF THE DISCLOSURE

The present disclosure relates generally to the generation of electricity and, more particularly, to the generation of electricity using downhole equipment installed within a producible oil and gas well.

BACKGROUND OF THE DISCLOSURE

A producible oil and gas well often utilizes some type of permanent or semi-permanent downhole equipment installed for the purpose of increasing initial or future hydrocarbon production. One such piece of downhole equipment is an electrical submersible pump (ESP). An ESP is commonly used in a method of artificial lift that employs surface-generated electricity to power the ESP located within a completed wellbore. The ESP supplements a natural pressure provided by a geologic formation to help "lift" hydrocarbons to the surface.

ESPs are efficient and well understood and thus, have been successfully utilized to assist in hydrocarbon production within the oil and gas industry for many years. However, since ESPs generally rely on surface-generated electricity, many ESPs may remain non-functional in remote locations such as offshore platforms that have not yet been electrified.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system may include a first wellbore penetrating a subterranean production zone and a first downhole electrical submersible pump (ESP) assembly operable to generate electricity and installed within the first wellbore. The first downhole ESP assembly may include a pump intake fluidly coupled to the subterranean production zone to receive formation fluids therefrom and the pump may be operatively coupled to the pump intake. The pump may further include an impeller rotatable response to a flow of the formation fluids from the pump intake. The first downhole ESP assembly may also include a motor generator operatively coupled to the impeller to generate electricity in response to rotation of the impeller, a controller disposed at surface and in communication with the first downhole ESP assembly wherein the controller may be configured to receive electricity from the motor generator and to distribute the electricity, and an electrical apparatus operatively coupled to the controller to receive the electricity from the controller.

According to another embodiment consistent with the present disclosure, a method of powering an electrical apparatus may include installing a first electrical submersible pump (ESP) assembly into a first wellbore wherein the first ESP assembly may be operable to generate electricity in the first wellbore. The method may also include receiving a flow of formation fluid from the first wellbore into a pump intake of the first ESP assembly and rotating an impeller positioned inside a pump of the first ESP assembly in response to receiving the flow of formation fluid. The method may also include generating electricity with a motor generator of the first ESP assembly operably coupled to the impeller in response to rotating the impeller and transmitting the generated electricity from the first ESP assembly in first wellbore to a controller at a surface location. Lastly, the method may include distributing the generated electricity from the controller to the electrical apparatus.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
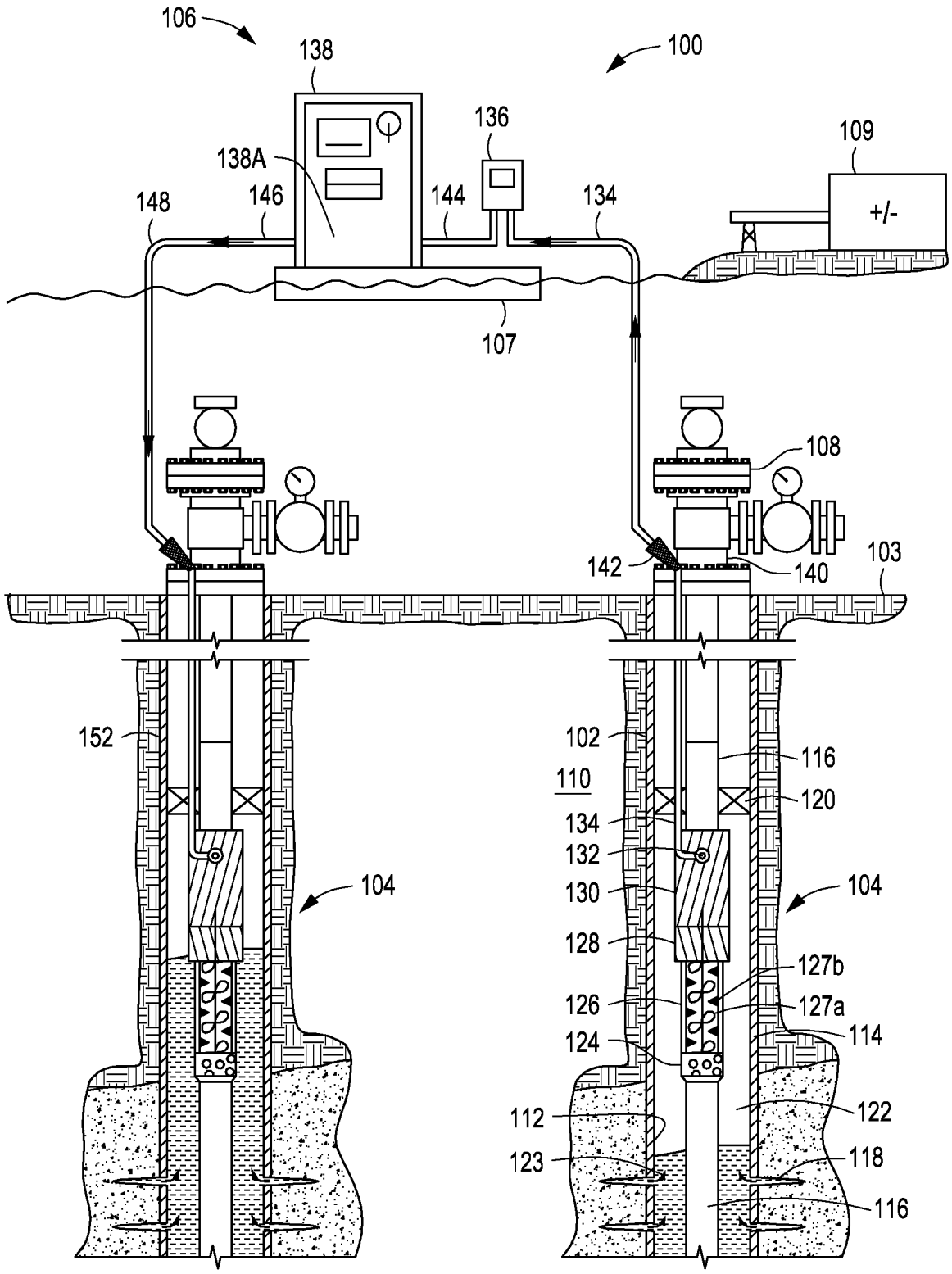
FIG. 1 is a partial schematic diagram of an example wellbore system that may embody or otherwise employ one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to the generation of electricity and, more particularly, to the generation of electricity with artificial lift equipment installed within a producible oil and gas well, namely, an electrical submersible pump (ESP) system powered by the natural flow of the reservoir. Those with knowledge of hydrocarbon production may be familiar with artificial lift as a means to increase production of formation fluids (e.g., hydrocarbons) and more particularly, ESP systems. Accordingly, those with knowledge will be familiar with a conventional configuration for an ESP system, wherein surface supplied electricity powers a downhole motor that ultimately drives a downhole pump. As formation fluids enter the wellbore from the producing reservoir, the formation fluid is drawn into the pump. The downhole pump then pressurizes the formation fluid such that the added pressurization assists in artificially lifting the fluids uphole.

According to embodiments of the present disclosure, the same type of electrical submersible pump (ESP) (and the additional components that make up an ESP system) may be utilized in a non-conventional manner. In the present disclosure, the formation fluid (acting under the pressure of the reservoir) serves as a source of energy to enable the pump and the associated ESP system to generate electricity. Such use of an ESP system may be advantageous in a variety of applications, but particularly in an offshore platform having multiple wells in which ESPs have been installed, and especially where the platform itself has not yet been electrified (i.e., un-electrified). Additionally, it is of note that wellbores employing the components and methodology of this disclosure, may continue to produce hydrocarbons conventionally, albeit at a reduced rate.

FIG. 1 is a schematic diagram of an example wellbore system 100 that may embody or otherwise employ one or more principles of the present disclosure. In the illustrated embodiment, the wellbore system 100 includes a first wellbore 102 extending from a seafloor 103 or other well surface location, a first downhole electrical submersible pump (ESP) assembly 104, and surface components externally located to the first wellbore 102 that in combination may be referred to as the ESP surface equipment 106. In the embodiment illustrated in FIG. 1 at least a portion of the ESP surface equipment 106 may be located on an offshore platform 107.

The first wellbore 102 extends from a wellhead 108 on the seafloor 103 and through various earth strata into a formation 110 further comprising at least one producible reservoir or production zone. The first wellbore 102 is generally vertical but in other embodiments may comprise a generally deviated portion without exceeding the scope of the disclosure. Similarly, in the present example, the first wellbore 102 is associated with the offshore oil and gas platform 107, and the platform 107 is operable to support the surface equipment 106 necessary to carry out the operations of the disclosure. In at least one embodiment, the offshore platform 107 may not be connected to a terrestrial source of electricity 109. Nor does the platform 107 necessarily include a surface-positioned generator. As illustrated, the platform 107 does include surface equipment 106 that may include a junction box 136 and a controller 138.

In one or more embodiments, the wellhead 108 is located at the seafloor 103 and is not included within the surface equipment 107. It will be appreciated by those skilled in the art that the various embodiments discussed herein are equally well suited for use in conjunction with other types of oil and gas platforms or rigs, such as land-based oil and gas rigs or rigs located at any other geographical site. Accordingly, in other embodiments, the wellhead 108 may be positioned on the terrestrial surface in a land-based operation. In yet other embodiments, the wellhead 108 may be positioned on the platform 107 of an offshore wellbore without departing from the scope of this disclosure.

The first wellbore 102 may be lined with one or more strings of casing 112 cemented within the first wellbore 102 using cement 114. In the present embodiment, a string of tubing 116, such as production tubing, may extend from the wellhead 108 (or similarly, from an extension of casing or liner) and be emplaced within the casing 112. In some embodiments, the casing 112 may be omitted from some portion of the distal end of the first wellbore 102. Accordingly, the first wellbore 102 may be constructed as operationally necessary without departing from the scope of this disclosure.

In at least one embodiment, the first wellbore 102 includes a plurality of perforations 118 extending radially outward through the casing 112 and the cement 114 and into the formation 110. The perforations 118 help facilitate fluid communication between the formation 110 and the first wellbore 102 such that the perforations 118 provide conduits through which hydrocarbons (e.g., oil and gas) can migrate into the first wellbore 102 for production, or as in the present embodiment, so that the hydrocarbons may power the first downhole ESP assembly 104.

A packer 120 provides a fluid seal between the tubing 116 and the inner walls of the first wellbore 102 (e.g., the casing 112) thereby isolating an annulus 122 above and below the respective packer 120. In other embodiments (not shown), the packer 120 may provide a seal between the tubing 116 and the formation 110 where the casing 112 is not provided. The packer 120 thus serves as a mechanical barrier to flow within the annulus 122. In some embodiments, the wellbore 102 may include discrete production intervals targeting different reservoirs which may be separated by one or more packers 120 such that the annulus 122 between the packers 120 is a barrier to flow between the discrete production intervals or reservoir zones.

As mentioned, in wellbores completed for the production of hydrocarbons, some form of artificial lift equipment may be installed to increase or facilitate initial production, and or future production. The artificial lift equipment utilized herein comprises the electrical submersible pump ESP assembly 104 and an array of surface located components, in combination referred to as the ESP surface equipment 106 (or alternatively the "surface equipment 106"). The ESP assembly 104 may include a motor, a seal-chamber, a pump intake, and a pump as described in greater detail below. In some embodiments, the ESP assembly 104 may further include one or more downhole sensors capable of recording and transmitting real-time downhole parameters to surface. Where the formation 110, or more particularly, a reservoir within the formation 110, does not have adequate pressure to allow the hydrocarbons to flow naturally to surface, for example in a second wellbore 152 described in greater detail below, a second ESP assembly 104 may be emplaced within the second wellbore 152 in order to artificially "lift" the hydrocarbons to surface for production.

In the first wellbore 102, the downhole ESP assembly 104 is arranged along the length of the tubing 116 extended into the first wellbore 102. According to embodiments disclosed herein, the ESP assembly 104 may be arranged and operated such that the natural flow of formation fluids 123 through the ESP assembly 104 serves as a source of energy that powers a downhole motor to generate electricity. Accordingly, as illustrated in FIG. 1, the ESP assembly 104 comprises a pump intake 124, a pump 126, a seal chamber 128, and a motor generator 130.

The pump intake 124 may comprise a generally cylindrical body operable to accommodate the flow of fluid within its hollow interior. The pump intake 124 serves as the point of entry for formation fluids 123 into the first ESP assembly 104, and more particularly, into the pump 126. The pump intake 124 may also be situated above the perforations 118. Thus, in a producing first wellbore 102, as disclosed herein, some portion of the formation fluids 123 may enter the production tubing 116 from wellbore zones downhole of the wellbore zones illustrated in FIG. 1. The pump intake 124 may further be positioned below (or downhole) from the packer 120. Accordingly, some portion of the formation fluids 123 may enter the body of the tubing 116 via the pump intake 124 wherein the packer 120 positioned uphole from the pump intake 124 prevents formation fluids 123 from flowing to surface via the annulus 122.

In some embodiments, the pump intake 124 may be the most distal component of the ESP assembly 104. In other embodiments, the ESP assembly 104 may be configured so that the pump intake 124 is not the most distal component of the ESP assembly 104. The pump intake 124 is operatively coupled to the pump 126 by means of threaded engagement (e.g., American Petroleum Institute (API) threads), situating the pump intake 124 upstream (downhole) from the pump 126. In other embodiments, the pump intake 124 may be operatively coupled to the pump 126 by another known means of matable connection. In yet other embodiments, the pump intake 124 may be an integral component of the pump 126. An exterior body of the pump intake 124 may comprise a screen (e.g., ports, slits) wherein the screen serves to filter and prevent any unwanted debris from entering the pump 126 positioned downstream (or uphole) from the pump intake 124.

The pump 126 may have a generally cylindrical exterior body and a hollow interior configured to house the components of the pump 126 and operable to receive the formation fluids 123. In some embodiments, the pump 126 may be a staged centrifugal pump (similarly referred to as a multistage centrifugal pump) wherein each stage comprises an impeller 127*a* and a diffuser 127*b* housed within the interior of the pump 126. The pump 126 may further have a center drive shaft arranged within its interior and extending the full length of the pump 126 (and into the additional components of the ESP assembly 104, to be discussed below).

The impeller 127*a* may comprise a plurality of blades (i.e., vanes) directly coupled to the center shaft and thus, operable to rotate about the center shaft as formation fluids 123 flow into and past the blades. The number of blades and the angle at which the blades are oriented may be configured to accommodate the potential (or desirable) flow rate of the formation fluids 123. Once the formation fluid 123 enters the ESP assembly 104 via the pump intake 124, the energy of the natural pressure of the formation fluids 123 causes the blades of the impeller 127*a* to rotate, resulting in a pressure drop in the flow of the formation fluids 123.

The pump 126 comprises multiple stages and accordingly, the pump 126 includes a plurality of impellers 127*a* and associated diffusers 127*b*. A localized pressure drop in the formation fluids 123 is observable as the formation fluids 123 travel through each stage. As shown in FIG. 1, the stages (e.g., corresponding impeller 127*a* and diffuser 127*b*) may be stacked contiguously and are operatively coupled to one another. In other embodiments, a single stage pump may be provided including a single impeller 127*a* and single diffuser 127*b*.

The seal chamber 128 is positioned above or uphole (similarly, downstream) from the pump 126. The seal chamber 128 (similarly referred to as the motor seal, equalizer, and or balance chamber) may comprise a generally cylindrical exterior body with a hollow interior through which a drive shaft connected to the drive shaft of the pump 126 extends. The drive shaft may extend the length of the seal chamber 128 and into the interior body of the operatively coupled motor generator 130. The drive shaft of the seal chamber 128 may be operable to transfer torque generated by the formation fluid 123 rotating the impellers 127*a* of the pump 126 to the drive shaft of the motor generator 130. Formation fluid 123 exits the pump 126 (more particularly, the diffuser 127*b* of the final stage) and flows into the seal chamber 128. The seal chamber 128 protects the motor oil from contamination arising from the passage of formation fluids 123 and assists in equalizing the pressure between the interior of the motor generator 130 and the first wellbore 102. Additionally, the seal chamber 128 may be operable to absorb the axial force that is generated by the pump 126.

In the present embodiment, the ESP assembly 104 comprises a single seal chamber 128. In other embodiments, the ESP assembly 104 may comprise a plurality of seal chambers 128 that may be run consecutively (or in series), to provide additional protection to the motor generator 130. The operator may configure the quantity of seal chambers 128 in accordance with the needs and requirements of the first wellbore 102.

As mentioned and illustrated in FIG. 1, the seal chamber 128 may be operatively coupled between the pump 126 and the motor generator 130, wherein the seal chamber 128 may be positioned directly below the motor generator 130. In the present embodiment, the seal chamber 128 is directly coupled by a threaded engagement, e.g., API threads, to the pump 126 and the motor generator 130. In other embodiments, the seal chamber 128 may be coupled by any known means.

Upon exiting the seal chamber 128, the formation fluids 123 may pass through the motor generator 130. The motor generator 130 may be positioned above or uphole from (or similarly, downstream from) the seal chamber 128. Correspondingly, the motor generator 130 may be operatively coupled to immediately adjacent components by means of threaded engagement. In the present embodiment, the motor generator 130 is operatively coupled to the seal chamber 128 (at the distal end of the motor generator 130) and the tubing 116 (at the upper end of the motor generator 130 or the end closest to surface) via API threads. In other embodiments, the motor generator 130 may be operatively coupled by any known means without departing the scope of this disclosure.

The motor generator 130 may be configured to convert the mechanical energy produced by the pump 126 to electricity. The motor generator 130 itself may comprise a generally cylindrical exterior body with a generally hollow interior configured to house components necessary to make the motor generator 130 operable to generate electricity. The interior components and inner workings of the hydroelectric motor generator 130 are beyond the scope of this disclosure but will be understood by those with skill in the art. Accordingly, the inner components of the motor generator 130 will not be discussed in great detail. However, most significant to the present disclosure, the motor generator 130 includes a drive shaft operatively coupled to or forming an axial extension of the drive shaft extending from the seal chamber 128 and the pump 126. Accordingly, the rotational force (torque) is transferred from the seal chamber 128 via the drive shaft to the motor generator 130, providing the motor generator 130 the necessary rotational input to generate an electrical current. More particularly, the motor generator 130 converts the mechanical energy from the pump 126 to electrical energy via interaction between a magnetic field and a wire winding.

The motor generator 130 may further include an orifice 132 defined within the sidewall of its exterior body. Through this orifice 132, a power cable 134 may be operatively and communicably coupled to the motor generator 130 thereby enabling the transmission of electricity to surface. Accordingly, the power cable 134 may be extended into the first wellbore 102 and positioned laterally along the tubing 116 from the wellhead 108 to the orifice 132. In some embodiments, the power cable 134 may be directly coupled to the exterior body of the tubing 116 via clamps (or by other known mechanical means) at discretionary intervals so that the tubing 116 may provide structural support to an otherwise elastic power cable 134.

To carry out the operations of the present embodiment, the ESP system 100 may further include ESP surface equipment 106. As mentioned, the ESP surface equipment 106 may comprise equipment arranged atop the platform 107 including a junction box 136, and a controller 138.

As discussed above, the wellhead 108 is located at the seafloor and positioned atop the first wellbore 102 to provide structural support and pressure containment for the first wellbore 102. In the present embodiment, the wellhead 108 configuration includes a tubing head housing 140 (alternatively referred to as the "housing 140") that directly supports the extension of tubing 116. The housing 140 may further include a mandrel 142 (similarly known as a well penetrator) operable to receive the power cable 134 so that it may extend from the motor generator 130 through the housing 140 to surface. In at least one embodiment, the mandrel 142 may comprise a generally cylindrical exterior body with a hollow interior configured to receive the power cable 134 and operatively coupled to the tubing housing 140 of the wellhead 108. In other embodiments, the power cable 134 may extend through the housing 140 via a mechanism or method other than a mandrel, without exceeding the scope of this disclosure.

The junction box 136 may be positioned at surface. In the present embodiment, wherein the first wellbore 102 is extended from an offshore oil and gas platform (not shown), the junction box 136 may be positioned on a deck of the platform. In other embodiments, where the first wellbore 102 extends from a land-based oil and gas rig, the components comprising the surface equipment 106 including the junction box 136 may be positioned at the terrestrial surface. The junction box 136 (alternatively referred to within the industry as a "vent box") serves to operatively and electrically couple the downhole cable 134 and a surface positioned power cable 144. The junction box 136 is further operable to vent potential gas that may have migrated up the wellbore 102 via the downhole cable 134.

As electricity is generated downhole by the motor generator 130, the electricity may be continuously transmitted (or otherwise) to surface via the downhole power cable 134 such that it may be received by the junction box 136. Once received the transmitted electricity may exit the junction box 136 via the surface cable 144. The surface cable 144 may be operatively and communicably coupled opposite the junction box 136 to the controller 138.

The controller 138 comprises a surface positioned module operable to receive, store, and distribute or transfer downhole generated electricity. For example, the controller 138 includes a power storage and transfer device 138A therein, which may include batteries for power storage, switches for power direction, and logic for controlling where and when the electric power is distributed. Accordingly the controller 138 may include the electronic components necessary to receive, store, and transmit electricity. The controller 138 may also include an outlet 146 wherein the electricity may exit the controller 138 and be transmitted by a power cable 148 at the direction of the operator. For example, the controller 138 may distribute the electricity through the outlet 146 to one or more electrical apparatuses arranged for receiving the electricity and consuming electrical energy. In some embodiments, the outlet 146 may be electrically coupled to an electrical apparatus, such as a second ESP assembly 104 deployed in a second wellbore 152. The second wellbore 152 may be similar to first wellbore 102, and formation fluids 123 originating from the second wellbore 152 may be lifted to the surface with the ESP assembly 104 powered by the electricity received through the outlet 146, as discussed in greater detail below.

Figure 2:
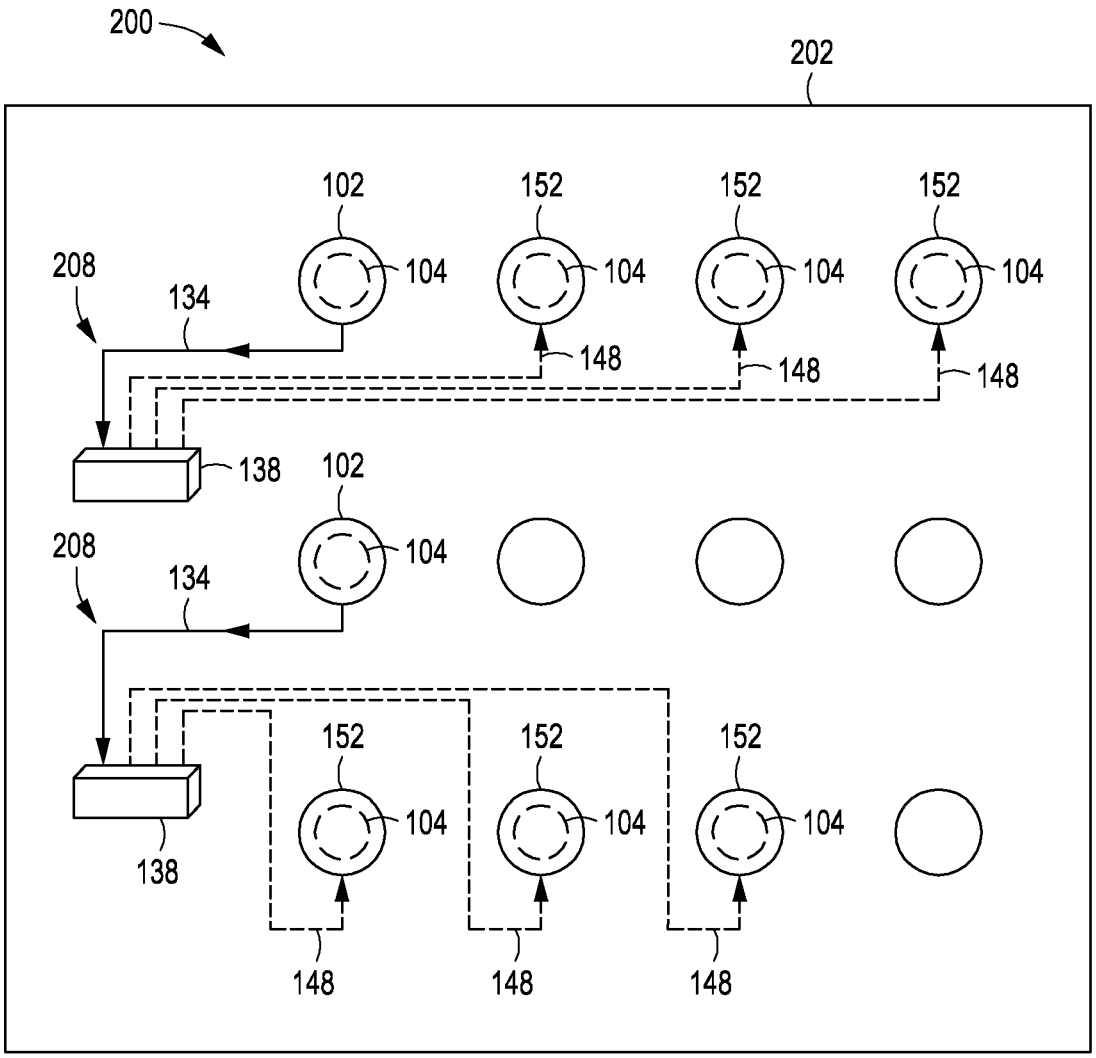
FIG. 2 is a schematic diagram of the wellbore system illustrating an offshore oil and gas platform coupled to a plurality of wellbores, each wellbore having an ESP installed therein.

FIG. 2 is a schematic diagram of an example offshore oil and gas platform including a wellbore system 200 that may embody or otherwise employ one or more principles of the present disclosure. The wellbore system 200 includes an offshore oil and gas platform 202 that comprises slots corresponding with wells (or wellbores) that have been drilled and completed in a similar configuration and construction to that of the wellbores 102, 152 of FIG. 1. The wellbores 102, 152 of FIG. 2 similarly include downhole ESP assemblies 104 configured and operable for conventional artificial lift operations wherein the associated producible reservoirs may or may not have the natural pressure to lift the hydrocarbons to surface.

Each first wellbore 102 includes a corresponding ESP assembly 104 configured to generate electricity in response to formation fluids flowing therethrough under the natural formation pressure, and the electricity generated may be transmitted to the platform 200. Accordingly, the first wellbores 102 penetrate reservoirs with sufficient pressure and flow rate to make operable their respective downhole ESP assemblies 104 for the purpose of generating electricity. More specifically, the downhole motor generator 130 (FIG. 1) included in the downhole ESP assemblies 104 may generate electricity that may then be transmitted to surface (platform 202) where it is transmitted through the ESP surface equipment 106 (FIG. 1) and ultimately to the respective controllers 138 where it may be stored and/or transmitted as necessary.

In one or more embodiments, the platform 202 may accommodate two or more controllers 138. The transmitted electricity 208 generated by the first wellbores 102 exits the respective first wellbores 102 via the corresponding power cable 134 where it is transmitted to the respective controllers 138. The controllers 138 may then transmit the electricity by means of corresponding power cables 148 to the second wellbores 152 having ESP assemblies 104 arranged for receiving and consuming the electrical energy, thus making them operable for artificial lift.

As illustrated in FIG. 2, each first wellbore 102 that generates electricity is operably coupled to three second wellbores 152, which may receive electricity therefrom and consume electrical energy for artificial lift. In other embodiments, different ratios may be defined based on formation pressures, wellbore depths, geological properties, operator schedules, available resources etc.

In some embodiments, the controllers 138 may transmit electricity at the discretion and direction of a remote operator, wherein the controller 138 may be operable via a supervisory control and data acquisition (SCADA) system. In such an embodiment, the operator may utilize a configuration of downhole and surface positioned sensors operable to monitor real-time parameters including but not limited to downhole pressure, generator rpms, and flow rate. The operator may, upon review of the real-time data, direct the SCADA to transmit power (i.e., electricity) to the ESP assemblies 104 as necessary. In other embodiments, the SCADA may be operable to regulate the transmission of electricity without the oversight of an operator. In such an embodiment, the operator may set parameter thresholds or limits that when reached, may activate a transmission of electricity or similarly, a changed rate of transmitted electricity.

In some embodiments, the generated electricity may be utilized to power other components or systems not associated with the wellbore system 200 (downhole or otherwise).

For example, the first wellbores 102 may be the source of electricity for some or all of the electrical components of the platform 202, wherein the platform 202 may not be electrified (i.e., un-electrified), temporarily or otherwise. An ESP assembly 104 operating as a generator may be particularly advantageous in powering a newly constructed platform wherein a traditional method of electricity has not yet been installed. Accordingly, the ESP assembly 104 within a first wellbore 102 may be the source of electricity for any components associated with or positioned upon the platform 202, without departing the scope of the disclosure.

Figure 3:
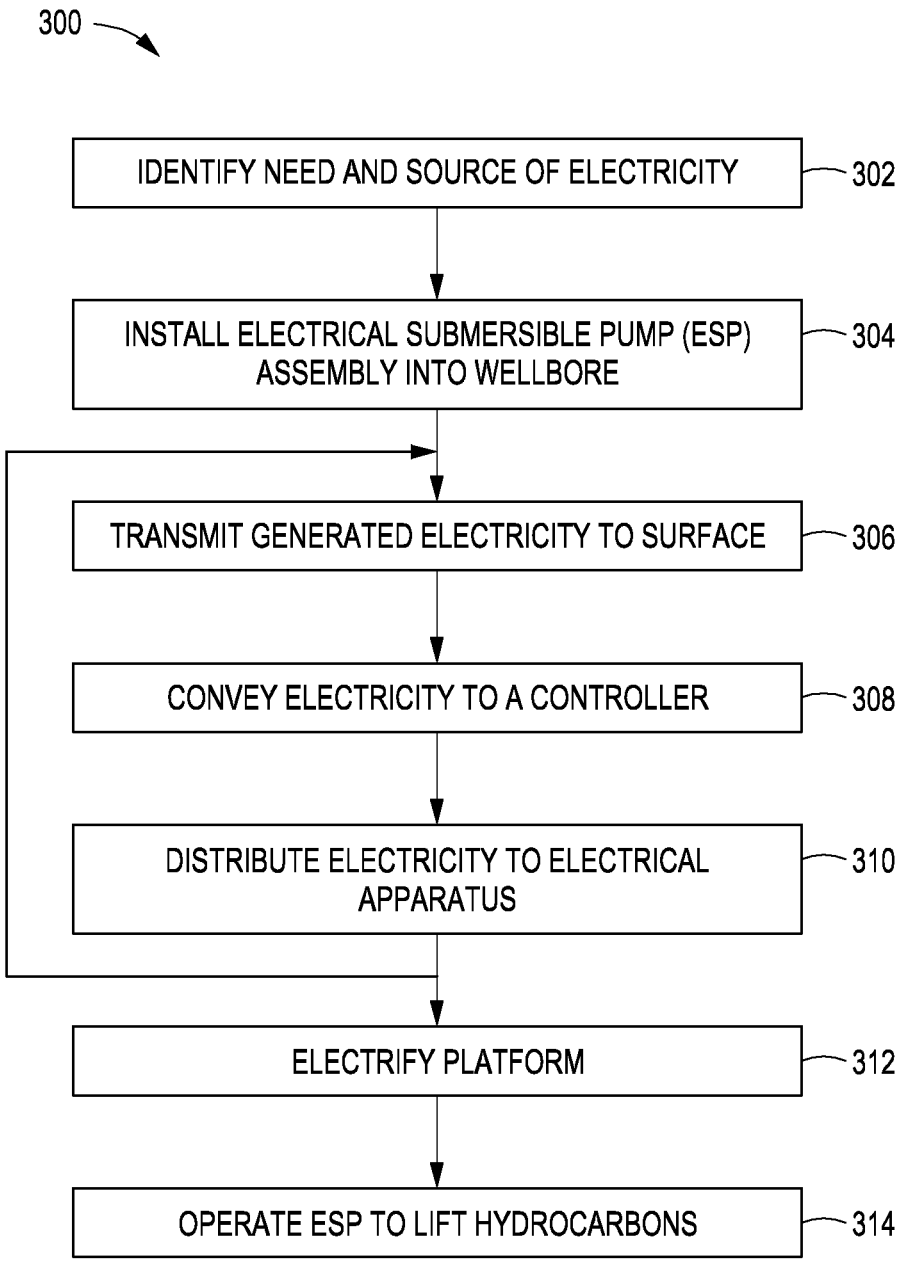
FIG. 3 is a schematic flowchart of an example electricity generation operation method utilizing artificial lift equipment, according to one or more embodiments.

FIG. 3 is a schematic flowchart of an example electricity generation method 300 utilizing artificial lift equipment, according to one or more embodiments. The method 300 may include identifying one or more wellbore locations where electricity may be produced and one or more locations where the electricity may be needed (e.g., wellbores 152), as at 302. The method 300 may include installing an electrical submersible pump (ESP) assembly into a wellbore that penetrates a subterranean formation including a producible reservoir, as at 304. The wellbore may be completed with a string of production tubing, wherein the ESP assembly may be emplaced within the tubing at or near the distal end of the wellbore. Further, the ESP assembly may be configured so that the pump intake is positioned at the distal end of the assembly (and closest to the reservoir) and the motor generator may be positioned uphole from the pump and closest to the surface. The motor generator may generate electricity via the natural flow and pressure of the reservoir, which enters the pump intake making the pump, and consequently the motor generator, operable.

The method 300 may include transmitting the downhole generated electricity to surface, as at 306. The generated electricity may be transmitted from the motor generator via a power cable emplaced within the wellbore and extending to surface. The power cable may exit the wellbore via the wellhead, and may extend to a junction box where it may be vented of potential gas and coupled to a surface positioned electricity cable. The method 300 may include conveying the electricity from the junction box to a point of distribution, or more particularly, to a controller, as at 308. The conveyance may occur by transmission through a surface located power cable.

The method 300 may then include distributing the downhole generated electricity to an electrical apparatus, as at 310. The electrical apparatus may be operable to receive and utilize the generated electricity. In some embodiments, the electricity may be transmitted to other wellbores that include corresponding ESP assemblies operable for artificially lifting hydrocarbons to surface for production. In some embodiments, step 310 may further include determining an amount of generated electricity to be distributed to each of a plurality of second wellbores with the controller. For example, the controller may determine the amount of generated electricity to each of the second wellbores to provide a desired flow rate of the formation fluids from each of the second wellbores.

In some embodiments, the method 300 may further include electrifying an oil and gas rig or platform with the generated electricity, as at 312. In such embodiments, where the method 300 includes electrifying the platform, the next step may include operating the first wellbores 102 in the normal manner such that the first ESP assemblies receive electricity from the electrified platform and are operated to artificially lift hydrocarbons to surface for production, as at 314. Some steps of the method 300 may be repeated continuously wherein electricity in continuously generated, as at 306, transmitted to surface, as at 308, and then distributed to any electrical apparatus, as at 310, as directed by the well operator.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system comprising:

a first downhole electrical submersible pump (ESP) assembly operable to generate electricity and installed within a first wellbore, the first downhole ESP assembly including:

a pump intake in fluid communication with the subterranean production zone to receive formation fluids therefrom;

a pump operatively coupled to the pump intake and including an impeller rotatable in response to a flow of the formation fluids from the pump intake; and a motor generator operatively coupled to the impeller to generate electricity in response to rotation of the impeller;

a second downhole ESP assembly installed within a second wellbore;

a controller externally located to the first wellbore and in communication with the first and second downhole ESP assemblies, wherein the controller is to receive the electricity from the motor generator and determine when to distribute the electricity to the second downhole ESP assembly.

2. The system of claim 1, wherein the first wellbore extends from a seafloor and is operatively coupled to an oil and gas platform.

3. The system of claim 2, wherein the oil and gas platform is un-electrified.

4. The system of claim 1, wherein the second downhole ESP assembly is one of a plurality of second downhole ESP assemblies in communication with the controller, and wherein the controller is operable to selectively distribute the electricity among the plurality of second downhole ESP assemblies.

5. The system of claim 1, wherein the first ESP assembly includes a plurality of pump stages stacked contiguously.

6. The system of claim 1, wherein the controller is positioned on an offshore oil and gas platform.

7. The system of claim 1, wherein the controller comprises a switch to control the distribution of the electricity to the second downhole ESP assembly.

8. The system of claim 1, wherein the controller comprises:

a battery to store the electricity; and logic to determine when the electricity is to be distributed from the battery to the second downhole ESP assembly.

9. The system of claim 1, wherein the controller is to distribute electricity to the second downhole ESP assembly based on a user input.

10. The system of claim 1, wherein the controller is to distribute electricity to the second downhole ESP assembly based on a threshold being reached.

11. The system of claim 1, wherein the controller is to distribute the electricity to the second downhole ESP assembly to provide a desired flow rate of formation fluids from the second wellbore with the second downhole ESP assembly.

12. A method, comprising:

installing a first electrical submersible pump (ESP) assembly into a first wellbore, the first ESP assembly operable to generate electricity in the first wellbore;

receiving a flow of formation fluid from the first wellbore into a pump intake of the first ESP assembly;

rotating an impeller positioned inside a pump of the first ESP assembly in response to receiving the flow of formation fluid;

generating electricity with a motor generator of the first ESP assembly operably coupled to the impeller in response to rotating the impeller;

transmitting the electricity from the first ESP assembly in the first wellbore to a controller at a surface location; and determining when to distribute the electricity from the controller to a second downhole ESP assembly installed within a second wellbore.

13. The method of claim 12, wherein transmitting the electricity includes transmitting the electricity to an un-electrified oil and gas platform.

14. The method of claim 13, further comprising electrifying the oil and gas platform and operating the first ESP assembly within the first wellbore to lift hydrocarbons from the first wellbore.

15. The method of claim 12, further comprising selectively distributing the electricity to a plurality of second downhole ESP assemblies to lift formation fluids from a plurality of second wellbores.

16. The method of claim 15, wherein selectively distributing the electricity to the plurality of second downhole ESP assemblies comprises determining an amount of electricity to be distributed to each of the second downhole ESP assemblies from the controller.

17. The method of claim 16, wherein determining the amount of electricity to be distributed to each of the second downhole ESP assemblies includes determining the amount of electricity to provide a desired flow rate of the formation fluids from each second wellbore.

18. A system, comprising:

a first downhole electrical submersible pump (ESP) assembly to be installed within a first wellbore penetrating a subterranean production zone, the first downhole ESP assembly including:

a pump intake to receive formation fluids from the subterranean production zone;

a pump operatively coupled to the pump intake and including an impeller rotatable based on the pump intake receiving the formation fluids; and a motor generator operatively coupled to the impeller to generate electricity based on rotation of the impeller;

a controller positioned on an offshore oil and gas platform and in communication with the first downhole ESP assembly, wherein the controller is to receive the electricity from the motor generator, and wherein the controller comprises logic for controlling distribution of the electricity to the offshore oil and gas platform; and a second downhole ESP assembly installed within a second wellbore, wherein the logic is to determine when to distribute the electricity to the second downhole ESP assembly.

* * * * *